United States Patent [19]

Palac

[11] Patent Number: 4,591,344

[45] Date of Patent: May 27, 1986

[54] METHOD OF FABRICATING A TENSION MASK COLOR CATHODE RAY TUBE

[75] Inventor: Kazimir Palac, Carpentersville, Ill.

[73] Assignee: Zenith Electronics Corporation, Glenview, Ill.

[21] Appl. No.: 725,724

[22] Filed: Apr. 22, 1985

Related U.S. Application Data

[62] Division of Ser. No. 538,001, Sep. 30, 1983.

[51] Int. Cl.[4] ..... H01J 9/30

[52] U.S. Cl. ..... 445/30; 445/45; 445/52

[58] Field of Search ..... 445/30, 37, 45, 52

[56] References Cited

U.S. PATENT DOCUMENTS

| | | | |
|---|---|---|---|
| 2,625,734 | 1/1953 | Law | 29/25.13 |
| 2,761,990 | 9/1956 | Amdursky et al. | 313/70 |
| 2,813,213 | 11/1957 | Cramer et al. | 313/78 |
| 3,037,834 | 6/1962 | Lederer et al. | 445/45 X |
| 3,440,469 | 4/1969 | Bradu et al. | 313/89 |
| 3,638,063 | 1/1972 | Tachikawa et al. | 313/348 |
| 3,722,044 | 3/1973 | Law | 445/37 |
| 3,873,874 | 3/1975 | Shinal | 313/402 |
| 3,894,321 | 7/1975 | Moore | 29/25.15 |
| 4,069,567 | 1/1978 | Schwartz | 445/30 |
| 4,495,437 | 1/1985 | Kume et al. . | |

FOREIGN PATENT DOCUMENTS 1163495 9/1969 United Kingdom .

*Primary Examiner*—Kenneth J. Ramsey
*Attorney, Agent, or Firm*—Ralph E. Clarke, Jr.

[57] ABSTRACT

A method of making a color cathode ray tube is disclosed that utilizes a tensed color selection electrode assembly as a stencil for screening a pattern of luminescent phosphor deposits upon a faceplate. The faceplate has a target area and a peripheral sealing area and a plurality of registration-affording means at selected locations about its periphery. The faceplate is utilizable as a constituent of a color cathode ray tube. Electrode assembly comprises frame means to which is bonded a planar tensed foil. Means are provided for bonding the faceplate and the frame means such that the frame becomes an integral part of the vacuum envelope for the tube during final assembly of the tube. Indexing means mechanically associated with the frame and cooperable with the faceplate registration-affording means to facilitate multiple registered matings of the frame and the faceplate during the screening. The method according to the invention comprises applying a photosensitive coating to the target area; registering the frame with a faceplate to enable the foil to serve as a screen stencil; causing the coating to be exposed to radiation actinic thereto such that the latent image of the pattern formed in the photosensitive coating corresponds to the patterns of electron beam landings on the target area when the tube is finally assembled and operating; removing the frame means and processing the exposed coating. The method steps are repeated for each method of elemental phosphor deposits desired to be established. The faceplate screening area is then sealed to the frame sealing area with a registration-affording means and indexing means in mating registration, whereby the frame becomes an integral constituent of the cathode ray tube envelope.

3 Claims, 5 Drawing Figures

METHOD OF FABRICATING A TENSION MASK COLOR CATHODE RAY TUBE

CROSS-REFERENCE TO RELATED APPLICATIONS

This application is related to but in no way dependent upon copending application Ser. No. 538,003 filed Sept. 30, 1983; Ser. Nos. 572,088 and 572,089 both filed Jan. 18, 1984; and Ser. Nos. 646,861 and 646,862 both filed Aug. 31, 1984; all of common ownership herewith.

BACKGROUND OF THE INVENTION

This application is a division of application Ser. No. 538,001 filed Sept. 30, 1983. This invention relates in general to color cathode ray having a flat faceplate and to a color selection electrode assembly for use therein. The invention is concerned with a method of manufacturing the electrode assembly and a cathode ray tube utilizing the assembly. The cathode ray tube which is the subject of the inventive method defined in this divisional application is described and claimed in the parent application.

In general, a color selection electrode or "shadow mask" is a device which is disposed adjacent the luminescent phosphor screen that forms the target electrode of a color cathode ray tube to control the landing pattern of one or more electron beams as they are swept across the screen. The shadow mask achieves color selection by partially shadowing the surface of the screen from the scanning electron beams, permitting access to selected elemental phosphor areas by those beams. The choice of a color selection electrode for use in color television cathode ray tubes is, by and large, a choice between a spherical or bi-radial electrode and a cylindrical electrode tensed upon a heavy spring frame—both types being supported within the tube envelope. The most common type of color selection electrode used in color television receivers today is the conventional curved type.

In color picture tubes utilizing a conventional shadow mask, there is a tendency on the part of the mask to "dome" (localized buckling) in those areas where a scene characterized by very high brightness is depicted. For example, in a scene where a high concentration of white is presented for an extended period of time, when the beams sweep that area of the screen, the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability of "doming," a conventional mask cannot accommodate the power density that a doming-resistant tensed mask can.

The general practice in cathode ray tubes manufactured for use in color television receivers is to position the mask at an assigned location, relative to the phosphor screen, by suspending it from three preselected points disposed about the periphery of the tube's face panel. This suspension accommodates overall thermal expansion of the mask by causing the mask to be displaced toward the screen from its original position by provision of bimetallic support springs: however, such provision cannot resolve the above-described localized "doming" problem caused by concentrated heating in localized areas of the mask.

An advantage of utilizing a tensed mask resides in the fact that the mask, while under tension, will not dome. The mask retains its desired configuration under normal operating conditions.

The color television cathode ray tube in most common usage today employs a faceplate which approximates a section of a large radius sphere. The shadow mask in such a tube is contoured to match the faceplate. A trend today is toward a flatter faceplate which, in turn, calls for a flatter shadow mask. However, a flatter mask is inherently less mechanically stable than a more curved mask. Accordingly, to acquire mechanical stability, resort is made to a thicker mask, for example, one having a thickness in the order to 10 to 12 mils. This is approximately twice the thickness of a conventional curved mask. However, when one must utilize a 10 to 12 mil mask, the aperture etching process is much more difficult. Specifically, in order to prevent aperture limiting of the beam at the outer reaches of the mask, the apertures have to be etched at an angle to the plane of the mask, rather than etched more perpendicular to that plane as is the case for a conventional curved mask.

Four photographic exposures are required in a typical process for applying light-emitting phosphor deposits on the screen. Each of the exposures requires the projection of a light field from a light source, typically through a light-refracting lens and the shadow mask onto a photosensitve layer deposited on the inside surface of the viewing window. There is a separate exposure for each of the red, green and blue light emitting phosphor deposits; a fourth exposure may be required for depositing the grille, or black-surround prior to the phosphor exposure and deposition process. After each exposure, the face panel must be removed from the light projection system used for screening (a system commonly known as a "lighthouse") and subjected to a developing and wash cycle. Then the face panel is replaced in precise registration with the shadow mask and another exposure is made, with the light source displaced laterally for each exposure relative to the axis of the lens. This process of exposure, removal and replacement is continued until all three phosphor deposits and the grille deposit are completed.

The method requires a mechanism whereby the faceplate may be removed and replaced in exact, precise registration with the shadow mask. The allowable error in panel-to-mask registration is about 0.006 inch in the domed-type of shadow mask and about 0.0002 inch in foil-type tension-type shadow mask tubes.

The conventional shadow mask is "indexed"; that is, made repeatably registerable with the phosphor deposits screened on the faceplate. This type of mask is typically mounted in close adjacency to the faceplate by a suspension system comprising three or four leaf springs. The springs are welded to the mask frame at selected points around the periphery. The distal ends of the springs are apertured to engage studs which project inwardly from the rearwardly extending flange of the tube faceplate. In the screening process, in which the phosphors and grille are deposited, the mask-frame assembly must be capable of being demounted and remounted with exact precision in relation to the faceplate several times, as required in the manufacturing process. Demounting the mask is accomplished by depressing the springs to disengage the studs and separating the panel from the electrode, usually by automatic machinery. In remounting, following the deposition of a phosphor, the mask and faceplate are again brought into propinquity whereby the springs are caused to reengage the studs. This process does not lend itself to the screening of a tube that utilizes the thin, foil mask heretofore described because of the lack of structural strength of the foil. The foil has no frame of the conventional type mountable by springs on the interior of the tube envelope.

DISCUSSION OF OTHER PRIOR ART

An early example of a tensed shadow mask for use in a color television cathode ray tube is described in U.S. Pat. No. 2,625,734. The tensed mask described therein was created by resort to a method called "hot-blocking." The practice was to insert a flat mask between a pair of frames which loosely received the mask. A series of tapped screws joining the two frames served to captivate the mask when the screws were subsequently drawn down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent to the phosphor screen. The mask is not used as a photoscreening stencil in the fabrication of the phosphor target on the faceplate. Rather, the mask and faceplates are manufactured independently and aligned on a light table.

U.S. Pat. No. 3,894,321 to Moore, of common ownership herewith, is directed to a method for processing a color cathode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than the glass to which it is mounted, hence following a heating and cooling cycle in which the mask is cemented at the funnel-faceplate juncture, the greater shrinkage of the mask upon cooling places it under tension. The mask is shown as having two or more alignment holes near the corners of the mask which mate with alignment nipples in the faceplate. The nipples pass through the alignment holes to fit into recesses in the funnel. In another embodiment, the front panel is shown as having an inner ledge forming a continuous path around the tube, the top surface of which is a Q-distance away from the faceplate for receiving the foil mask such that the mask is sealed within the tube envelope. An embodiment is also shown in which the faceplate is skirtless and essentially flat.

U.S. Pat. No. 2,813,213 describes a cathode ray tube which employs a switching grid mounted adjacent the phosphor screen to provide a post deflection beam deflecting force. Basically, it is proposed to employ a taut wire grid that is sealed in the tube envelope wall and which, in one embodiment, proposes the use of an external frame to relieve the tension forces applied by the taut grid to the glass wall of the tube. In another embodiment, which is not pictorially disclosed by simply textually referred to, an arrangement is proposed comprising a glass donut-shaped structure into which the grid wires are sealed. This donut assembly is then inserted between the faceplate of the tube and its conical section. Thereafter, the patent notes, after the tube is assembled, the phosphors may be deposited on the faceplate by conventional photographic processes. The application of elemental color phosphor areas to the faceplate of a tube is, in itself, a formidable task; how this could be achieved with a grid structure in situ across the faceplate is dismissed perfunctorily. As will be developed herein, the subject invention teaches, inter alia, how a foil shadow mask can be utilized to screen color phosphors on the faceplate of a color television tube.

In U.S. Pat. No. 3,638,063 there is a disclosed a 25-inch "Trinitron" color picture tube. This tube utilizes a tensed shadow mask in which a very heavy mask support frame is compressed prior to and during affixation of the mask to it. Upon release of the frame, restorative forces in the frame cause the mask to be placed under high residual tension. Although not described in the referent patent, it is assumed that this very heavy mask support frame is used in the screening of the faceplalce of the cathode ray tube.

The following patents also have relevance to this application: 1,163,495 (GB); 2,761,990; 3,440,469; 3,638,063; 3,873,874; 3,894,321; 4,069,567; and 4,495,437.

OBJECTS OF THE INVENTION

It is a general object of the invention to provide a method for making a color cathode ray tube having a tensed foil color selection electrode assembly.

It is a less general object of the invention to provide a method for making a color cathode ray tube utilizing a tensed foil color selection electrode assembly as a stencil for faceplate screening.

It is a more specific object of the invention to provide a method for utilizing a tensed foil color selection electrode as a stencil for use in the process of screening a faceplate.

It is a specific object of the invention to provide a method of making a color cathode ray tube wherein a tensed foil is used for faceplate screening and wherein the color selection electrode assembly is sealed to the faceplate so as to become an integral part of the tube envelope.

It is another specific object of the invention to provide a method of manufacturing a color television cathode ray tube which, in utilizing the improved tensed foil color selection electrode, effects substantial economies over prior manufacturing practices.

DESCRIPTION OF A PREFERRED EMBODIMENT

Figure 1:
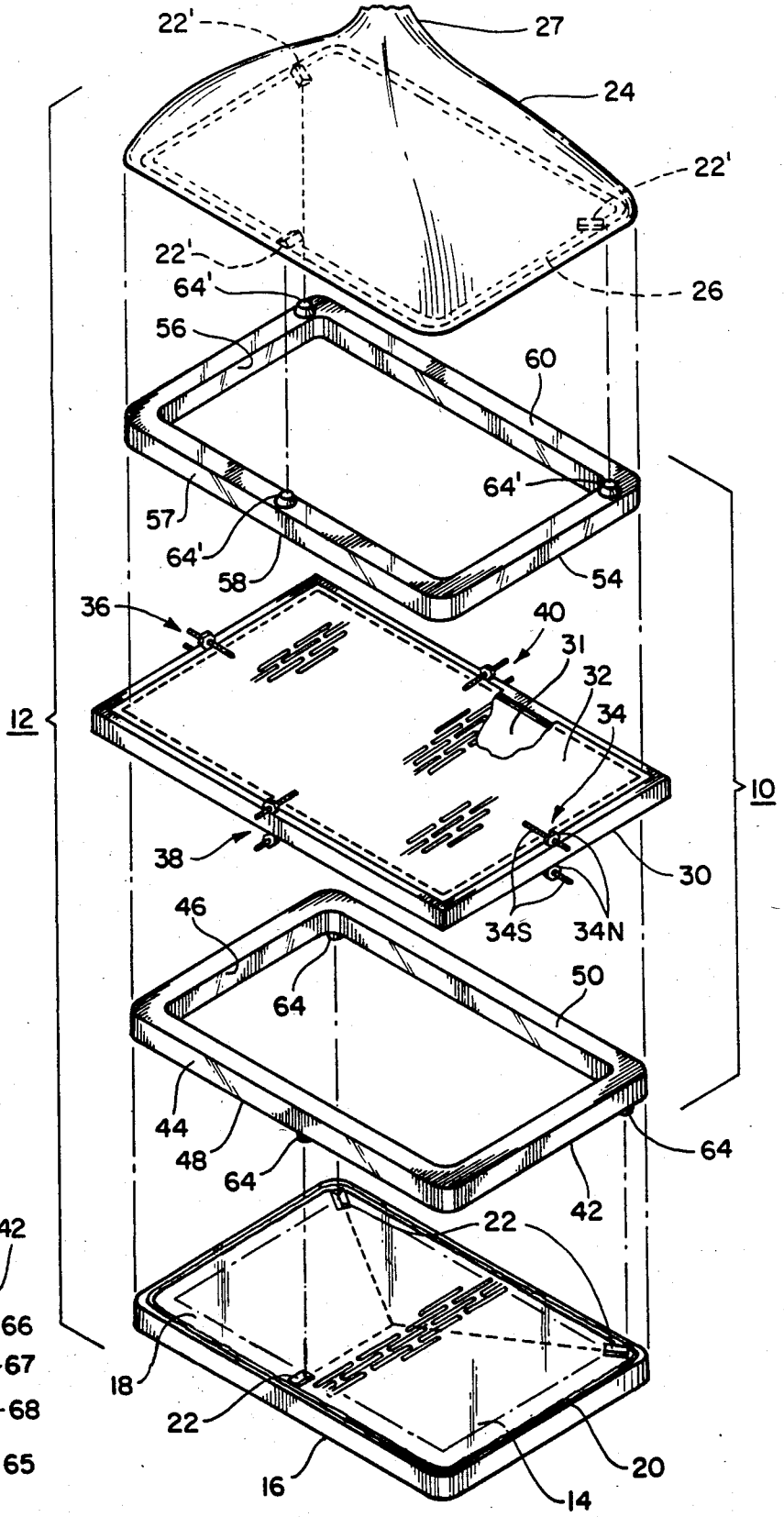
FIG. 1 is an exploded view in perspective of the principal components of a color cathode ray tube embodying the invention described and claimed in the parent application.

The color selection electrode assembly 10 shown by FIG. 1 is constructed in accordance with a preferred embodiment of the invention described and claimed in referent copending application Ser. No. 538,001 of which the present application is a division. Electrode assembly 10 is indicated as being associated with and forming an integral part of color television cathode ray tube 12. As will be described in accordance with the present invention, electrode assembly 10 is utilizable as a stencil for use in screening a pattern of luminescent primary color elemental phosphor areas upon the target surface 14 of the envelope section 16 that comprises the faceplate of tube 12. In the disclosed embodiment, faceplate 16 is depicted as a flat panel of glass preferably formed from sheet glass so as to take advantage of material substantially less expensive than a conventional glass face panel. The flat glass faceplate 16 has a predetermined temperature coefficient of expansion and has a sealing land 18 that circumscribes target surface 14. This sealing land, constitutes a surface for receiving a bead of frit 20, which is a devitrifying glass adhesive employed in fabricating cathode ray tubes. Preferably, the frit employed is a low-temperature solder glass material which is available from Owens-Illinois Inc. under their designation CV-130.

In any event, as will be shown, the electrode assembly 10, upon completion of this screening function, is thereafter, at the option of the practitioner, fritsealable to faceplate 16 to permit selective excitation of the primary color phosphors by a scanning electron beam(s) when that assembly forms a constituent of a color cathode ray tube. To this end, faceplate 16 is provided with registration-affording means or alignment elements, which take the form of a plurality of V-grooves 22; in this execution they constitute three slots which are milled into the surface of the faceplate's sealing land 18. Preferably, the included angle defined by the sloping walls of grooves 22 approximate sixty degrees and they are oriented so that the bottom of each groove lies along a line that extends radially from the geometric center of the faceplate.

While discernible only in phantom in FIG. 1, funnel 24 has a sealing land 26 which geometrically matches a mating surface of one component of electrode assembly 10, the composition of which is described in detail below. If desired, funnel sealing land 26 may be provided with a corresponding plurality of alignment elements which also take the form of V-grooves 22' milled into sealing land 26 and which can be spatially aligned with indexing means associated with the aforesaid one component of electrode assembly 10. Recourse to V-grooves 22' is optional since it is appreciated that other means for aligning the funnel sealing land 26 with electrode assembly 10 are well known. In fact, a common practice is to use an "outside" reference system, which, for the case at hand, would entail aligning the funnel to the electrode assembly, after that assembly had been mated to the faceplate, by positioning the funnel against referencing snubbers. For sealing purposes which will be described, either funnel land 26, or the upper sealing land surface of electrode assembly 10, is provided with a bead of devitrifying frit. Finally, funnel 24, which includes a neck 27, is formed of a material, e.g., a glass or ceramic composition, which preferably has the same or approximately the same temperature coefficient of expansion as faceplate 16.

The color selection electrode arrangement 10 shown in FIG. 1 comprises a temporary severable mount 30 defining a central opening 31 of a predetermined expanse. Mount 30, which adopts a rectangular configuration, is readily formed from four butt-welded strips of L-shaped angle metal. Strips of other geometry, of course, are also suitable. In any case, the four-sided mount is formed of a material having a temperature coefficient of expansion greater than that of envelope sections 16 and 24. Thus, mount 30 can be formed from cold rolled steel, stainless steel, nickel or Monel to name a few of the materials found acceptable in practicing the invention.

Electrode assembly 10 further comprises, at this stage, an untensed planar foil 32 which has a predetermined array, or pattern, of apertures which may be triads of minute circular holes or, as now favored in state of the art color television tubes, a myriad of elongated narrow slots disposed perpendicular to the major axis of the foil. The foil is tautly drawn across opening 31 of the mount under whatever tension is required to render the foil planar, and it is then secured to the four sides of mount 30 by brazing or welding. In a manner to be described, foil 32 will subsequently be converted to a tension mask. Foil 32 has a temperature coefficient of expansion which is not greater than that of mount 30 and, preferably, a temperature coefficient less than that of the mount. Thus, foil 32 can be foremd from cold rolled steel, or Invar, to name two substances, each of which are utilizable with mounts made from any of the above-mentioned mount materials.

Figure 2:
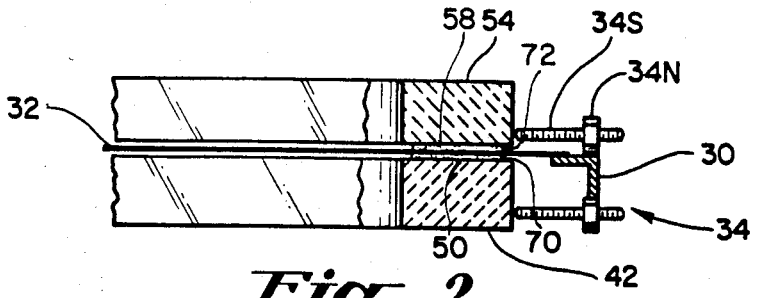
FIG. 2 is a fragmented sectional view of the electrode assembly shown in FIG. 1, in which components of that electrode are indicated as being partially assembled.
Figure 3:
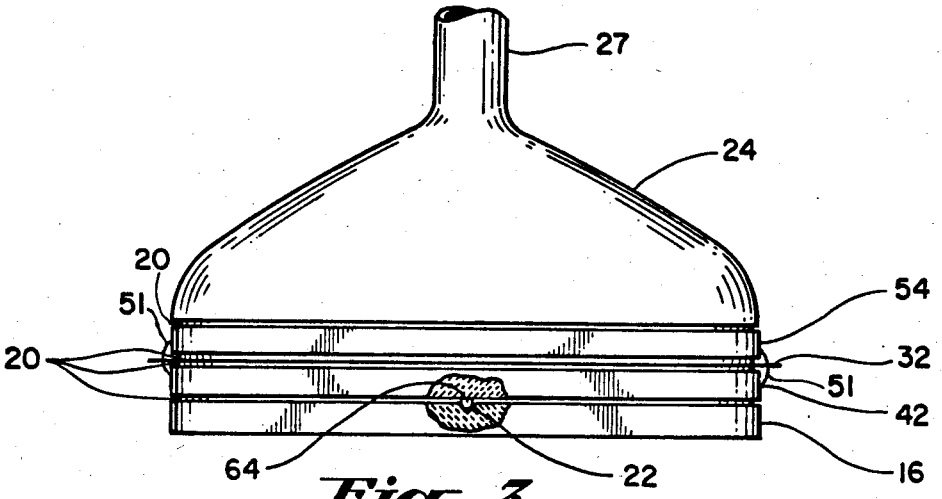
FIG. 3 is an elevational view of a partially assembled version of the tube shown in FIG. 1.

Desirably, the thickness of foil 32 is preferably less than 2 mils (0.002 in.); otherwise, unacceptable stresses may be induced in the envelope glass when the foil, under tension, is incorporated in a tube. Preferably, a foil having a thickness equal to, or less than, 1 mil (0.001 in.) is most suitable. For purposes which will soon be apparent, mount 30 is provided with a plurality of adjustable positioning devices. More particularly, four identical sets 34, 36, 38 and 40 of such devices are deployed around the mount with one set centered, approximately, upon each side of the mount. In this fashion, and as shown in FIG. 1, set 34 is disposed opposite set 36 while set 38 is opposite set 40. Since the sets of positioning devices are identical, only set 34 need be detailed. Accordingly, this set comprises a pair of inwardly directed threaded spindles **34*s* each of which is rotatably received in a conventional nut 34*n* for displacement along an axis perpendicular to the central axis of tube 12. One nut is secured, as by welding or brazing, to the upper surface, as viewed in FIG. 1, of its assigned mount side, while ther other is secured to the underside of the depending wall of that side; see also FIG. 2**.

In order to establish a permanent support for foil 32, electrode assembly 10 includes a first frame means comprising a substantially rectangular frame member 42 which has an overall span that is less than the expanse of central opening 31 in mount 30. In other words, the outside dimensions of frame member 42 are such as to permit the frame to be received within central opening 31 of mount 30. In practice, frame 42 is nested inside opening 31 of the mount with its outer bounding wall 44 abutting against the ends of the lower spindles of positioning devices 34, 36, 38 and 40. First frame member 42 defines a central aperture 46 which is dimensioned to enclose, or frame, target surface 14 of faceplate 16. Frame 42 is formed of a glass or ceramic material having a temperature coefficient of expansion approximately that of faceplate 16 and, if formed from glass, is desirably cut from the same type of sheet glass as that utilized for the faceplate. In the central axial direction, as viewed in FIG. 1, frame 42 is bounded by a pair of substantially flat, spaced-apart, parallel surfaces 48, 50 which comprise sealing lands that circumscribe aperture 46. The distance between surfaces 48, 50, in other words, the axial thickness of frame 42, is partially determinative of the Q-spacing for the cathode ray tube in which electrode assembly 10 is subsequently incorporated. Q-spacing is defined as the spacing between the luminescent screen of a cathode ray tube and its shadow mask; in this case, it is the spacing between target surface 14 and foil 32.

By way of further support for foil 32, electrode assembly 10 includes a second frame means comprising a substantially rectangular frame member 54 having an overall span that conforms substantially to the span of first frame member 42, and has a central aperture 56 substantially conforming, in expanse, to aperture 46 of frame 42. Frame 54 is also nestable within opening 31 of mount 30 with its aperture coaxially aligned with aperture 46 of frame 42, and with its outer bounding wall 57 abutting against the ends of the upper spindles of the mount supported positioning devices. The function of these adjustable positioning devices is now apparent: they serve to accurately align frame members 42 and 54 so that their respective apertures are coaxial, as well as to retain them in mount 30 for the subsequently to be described fabrication of the tensed color selection electrode assembly 10.

Frame 54 is preferably formed from the same type of material as that utilized for frame member 42 and thus has a temperature coefficient of expansion approximately that of faceplate 16. Frame 54 is also bounded by a pair of substantially flat, spaced-apart parallel surfaces 58, 60 that constitute sealing lands that circumscribe aperture 56 of this frame.

With frame members 42 and 54 supported in the manner shown and described, sealing land 58 of frame 54 is disposed in a confronting relation to sealing land 50 of frame 42, and with the periphery of foil 32 sandwiched therebetween. Specifically, foil 32 presents the upper side of a peripheral portion thereof to sealing land 58 of frame 54 and, at the same time, presents the lower or opposite side of that peripheral portion to sealing land 50 of frame 42. As has been indicated, electrode assembly 10 is utilizable as a stencil for screening a pattern of elemental phosphor areas upon target surface 14 of faceplate 16. Moreover, as can be appreciated, a precise and as important, a repeatable, kinematic registration between assembly 10 and faceplate 16 is essential in order to utilize foil 32 as a stencil in screening such a pattern upon that target surface. By way of securing the required precise registration between electrode assembly 10 and faceplate 16, sealing land 48 of frame member 42 has indexing means associated therewith. More particularly, such means comprises a plurality (three) of rounded abutments, or bosses, 64 selectively located upon and affixed to sealing land 48 for cooperation with the registration-affording grooves 22 milled into the surface of faceplate sealing land 18. The function of each bosses 64 is to effect a two-point contact with the groove it is received by, for a total six-point contact as between frame member 42 and faceplate 16. To that end, each boss adopts a geometry such that when it is seated upon the inclined walls of its assigned faceplate groove, the target surface of the faceplate and foil 32 are maintained in a predetermined spaced-apart relation; that is, the previously adverted to "Q-spacing." It is thus seen that, in addition to the axial thickness of frame member 42, Q-spacing is also determined by the geometry of V-grooves 22 and bosses 64. It is appreciated, of course, that the registration format can be reversed; that is, sealing land 48 of frame 42 can be provided with grooves while the faceplate sealing land is fitted with boss elements. Since bosses 64 will ultimately be frit-sealed between the faceplate sealing land and sealing land 48 of frame member 42, it is desirable that they be formed from a glass sealable material; e.g. a metal alloy. An alloy particularly suited for this purpose is available from Carpenter Technology Corporation of Reading, Pa. under their designation 430T1.

If it is decided that a like registration arrangment is desired to align electrode assembly 10 with funnel 24, a plurality of boss elements 64' can be selectively located upon and affixed to sealing land 60 of frame member 54 for cooperation with grooves 22' milled into the funnel's sealing land 26.

Figure 5:
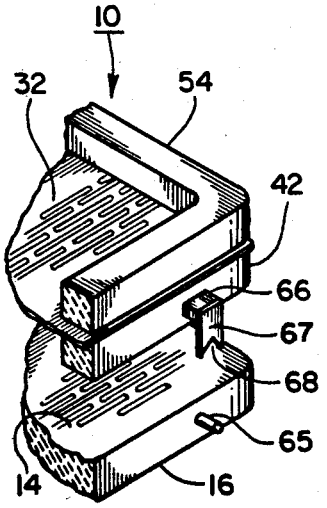
FIG. 5 is a fragmentary sectional view of a portion of CRT faceplate and a color selection electrode assembly depicting an alternative faceplate/color selection electrode registration arrangement according to an aspect of the invention disclosed in the referent Ser. No. 538,001 parent application.

On the other hand, an alternative registration arrangement for effecting six-point contact between electrode assembly 10 and faceplate 16 contemplates the external approach shown in FIG. 5. More particularly, as a registration-affording means, the faceplate 16 is fitted with three (only one shown) externally mounted, outwardly directed, break-away pins 65 which, geometrically, adopt the same relative locations as those occupied by V-grooves 22 on the faceplates shown in FIG. 1. Indexing means cooperating with each of the pins 65 comprises a break-away tab 66 affixed to lower frame member 42. Tab 66 has a depending finger 67 which, in turn, is provided with a bifurcation 68 at its distal end. Accordingly, to effect a kinematic registration with this embodiment, electrode assembly 10 is supported over the faceplate with a finger bifurcation 68 poised over its assigned pin. When the assembly 10 is lowered, a six-point contact is established between the three pins 65 and their cooperating bifurcations 68. This registration between the electrode assembly and the faceplate is repeatable as often as is required to accomplish screening of the target surface 14 of the faceplate, as well as to effect a final registration between the electrode assembly and the faceplate prior to frit sealing. After the funnel and faceplate have been fritsealed to bond electrode assembly 10 between their confronting sealing lands (a process described below), pins 65 may be broken away from the faceplate and tabs 66 broken away from frame member 42. Moreover, it is appreciated that the physical locations of the pins and the bifurcated fingers can be reversed and that other indexing structures within the knowledge of one skilled in the art could be employed. Of course, a like external registration arrangement can be adopted, if desired, for aligning funnel 24 with the foil mount.

Now that the basic components of electrode assembly 10 have been described, attention is directed to the fabrication of a tensed color selection electrode. Referring specifically to the fragmented sectional view of FIG. 2, as well as FIG. 1, a bead 70 of frit is applied to sealing land 50 of frame 42 and permitted to dry. In this instance, as well as in any other frit application hereinafter resorted to, the previously mentioned OwensIllinois type CV-130 is the preferred material. Another bead 72 of frit is applied to sealing land 58 of frame member 54 and is also permitted to dry. Mount 30, with foil 32 tautly secured thereto, is then positioned over frame 42 with the underside of the foil's peripheral portion in contact with frit bead 70. Frame member 54 is then nested into mount 30 with its frit bead 72 in contact with the upper side of the foil's peripheral portion. Positioning devices 34, 36, 38 and 40 are then adjusted to coaxially align apertures 46 and 56 of respective frame members 42 and 54. It is appreciated, of course, that the frit applications are a matter of choice since the beads of frit can be applied to the upper and lower peripheral portions of foil 32 instead of to sealing lands 50 and 58.

This assemblage is then inserted into a heat chamber, or oven, the temperature of which is elevated to approximately 430 degrees Centigrade and maintained thereat for thirty to forty-five minutes. These are the temperature and time parameters required to devitrify low-temperature CV-130 frit material. As the temperature rises, frame members 42 and 54 will expand by an amount determined by their characteristic temperature coefficients of expansion. Simultaneously, mounted 30 and foil 32 will also expand but, because of their greater temperature coefficients of expansion, their growth, relative to the frame members, will be greater. By the time this assemblage has reached a temperature of 430 degrees Centigrade, and by the time the frit has devitrified, mount 30 and foil 32 will have stabilized their expansion, as will have the frame members.

When the frit has devitrified, the periphery of foil 32 is captured therein between frame members 42 and 54. Thereafter, as the assemblage cools down to room temperature and the materials return, or attempt to return, to their normal dimensions, foil 32 will be tensed by virtue of being captured within the frit junctions between the foil periphery and frame sealing lands 50 and 60, which junctions will prevent the foil from returning to its normal room temperature dimension. Thus the mask, which was "grown" by the heat attendant upon the frit sealing process, is trapped in tension and is so maintained thereafter by the devitrified frit bonding the frame members and the foil.

After the frame members and the foil have been frit bonded, mount 30 is removed from the captured foil by severing the foil along the inside perimeter of the mount. (The mount, of course, is reuseable.) The foil is then trimmed as close to the outside perimeter of the frame-foil junction as possible.

Figure 4:
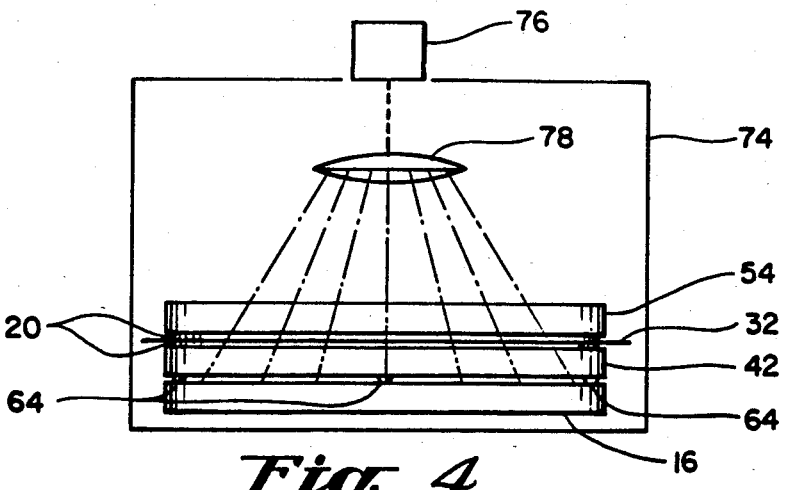
FIG. 4 is a schematic representation of a lighthouse arrangement for screening a cathode ray tube faceplate according to this invention.

There will now be described a method according to the invention that utilizes electrode assembly 10 as a stencil to screen a pattern of primary color elementary phosphor areas upon the target surface 14 of faceplate 16. An acceptable method of preparing a color phosphor screen utilizes a process which has devolved from familiar photographic techniques. To this end, a slurry comprising a quantity of a primary color phosphor particles suspended in a photosensitive organic solution, e.g., polyvinyl alcohol, is applied as a coating to the target surface 14 of faceplate 16. The now tensed electrode assembly 10 (sans mount 30) is then seated upon faceplate 16 by effecting a registration between bosses 64 and their assigned faceplate grooves 22. As schematically depicted in FIG. 4, the registered faceplate and electrode assembly is then inserted in a lighthouse 74 comprising a source of light 76 actinic to the photosensitive coating, and a beam trajectory compensating lens 78. This lens serves to compensate for the fact that the trajectory of an electron beam, under deflection, differs from the path of a light ray originating from the same point source as the electron beam. At any one instant, light source 76 occupies a spatial position corresponding, in effect, to the axial position of the source of the electron beam that will subsequently excite the phosphor pattern to be created. The slurry coating is then exposed to the actinic light rays that pass through compensating lens 78 before encountering the foil apertures. The light transmitted through foil 32 then creates a latent image fo the foil's aperture pattern on the coated faceplate.

Accordingly, after the initial exposure through lens 78, electrode assembly 10 is then removed and the substrate is washed. By way of example, in a positive-resist, positive-guardband system, this wash will remove the exposed portion of the coating. However, it is to be appreciated that the invention is equally utilizable in a negative-resist, negative-guardband system, or even in the tacky-dot dusting system. In any event, the exposed coating is processed to establish upon target surface 14 a pattern of elemental phosphor areas corresponding to the aperture pattern of foil 32.

The slurry coating, faceplate-electrode assembly registration, exposure and wash steps are then repeated for each of the other primary color phosphor areas to be applied to target surface 14, with the source of actinic light, of course, disposed at appropriately different positions with respect to assembly 10. A similar slurry coating, registration, exposure and wash procedure can be employed to provide the target surface with a black matrix pattern of the type employed in a negative guardband tube. The resultant luminescent screen comprises a pattern of interleaved primary color phosphor areas corresponding to the aperture pattern in foil 32. In practice, successive repositioning of the light source, prior to exposing the target screen through the foil, is such as to effectively mimic the positions of three scanning electron beams issuing from a gun mount later to be fitted to the tube. In this regard, it should be noted that the resultant luminescent screen pattern will bear a unique geometric relationship, or orientation, to the light sources and, thereby, to the electron beam axes of the subsequently fitted electron gun mount.

After the screening process has been completed, desirably, the electrode assembly 10 employed to pattern the screen is mated to faceplate 16 and to funnel 24. In this process, the upwardly facing sealing land surface 18 of faceplate 16 and the downwardly facing land surface 26 of funnel 24 are coated with beads of low-temperature frit which are permitted to dry. Again, the frit applications are a matter of choice since the beads of frit could as well be applied to first frame sealing land 48 and to second frame sealing land 60 instead of to surface 18 and 26. Assembly 10 is then re-registered with faceplate 16 by inserting bosses 64 into grooves 22. The sealing land of funnel 24 is then fitted over assembly 10 with its V-grooves 22' receiving bosses 64'. This assemblage is then inserted into the heat chamber, the temperature of which is again elevated to approximately 430 degrees Centigrade and maintained thereat for thirty to forty-five minutes. These are the temperature and time parameters required to devitrify low-temperature Owens-Illinois type CV-130 frit material. After this assemblage has reached a temperature of 430 degrees Centigrade, and after a suitable period of time at this temperature, the frit will have devitrified and electrode assembly 10 will be captured between funnel 24 and the faceplate 16 to form an integral part of cathode ray tube 12. Thereafter, when the assemblage cools down to room temperature, and the materials return to their normal dimensions, foil 32 will remain tensed by virture of its prior captivation by the frit junction which bonds frame member 42 to frame member 54 along their respective confronting fronting sealing lands 50, 58. Thus, the foil which was tensed by the heat attendant upon the frit-sealing process employed to fabricate electrode assembly 10, is trapped in tension and maintained thereafter by the devitrified frit that joins the frame members 42 and 54.

After the faceplate-electrode-assembly-funnel assemblage has been frit sealed and a neck section fitted thereto, the tube is subjected to an exhaust process. The frame-foil junction of electrode 10 is then covered with a coating of insulating material 51 to prevent external contact with the foil which, depending upon the excitation system utilized with the completed tube, may be maintained at a high electrical potential.

It is to be noted that the alignment elements utilized by the faceplate and funnel, as well as the indexing means used for the frame members, need not be restricted to the groove and boss format disclosed. Moreover, materials other than those disclosed for the envelope sections the frame members and the mount and foil can be used so long as the coefficients of expansions of such materials provide the differential expansion required to tense an initially untensed planar foil.

While particular embodiments and procedures of the method according to the invention have been shown and described, it will be obvious to those skilled in the art that changes and modifications may be made without departing from the invention in its broader aspects and, therefore, the aim of the appended claims is to cover all such changes and modifications as fall within the true spirit and scope of the invention.

What is claimed is:

1. A method of making of color cathode ray tube utilizing a tension color selection electrode assembly as a stencil for screening a pattern of luminescent phosphor deposits upon a faceplate having a target area and a peripheral sealing area, and a plurality of registration-affording means at selected locations about the periphery of said faceplate, said faceplate being utilizable as a constituent of a color cathode ray tube, said electrode assembly comprising:

frame means defining a central opening dimensioned to enclose said target area and including a peripheral sealing area;

indexing means mechanically associated with said frame means and cooperate with said faceplate registration-affording means to facilitate multiple registered matings of said frame means and said faceplate during screening of said target area;

a planar tensed foil bonded to said frame means and having a predetermined pattern of apertures; and, means for bonding said faceplate on said frame means such that said frame means become an integral part of the vacuum envelope for the tube during final assembly of the tube;

said method comprising:

(a) applying a photosensitve coating to said target area of said faceplate;

(b) registering said frame means with said faceplate to enable said foil to serve as a screen stencil by mating said registration-affording means and said indexing means;

(c) causing said coating to be exposed to radiation actinic thereto through the pattern of apertures in said foil such that the latent image of the pattern formed in the photosensitive coating corresponds with the pattern of electron beam landings on the target area where the tube is finally assembled and operating;

(d) removing said frame means;

(e) processing said exposed coating to establish a pattern of elemental phosphor deposits upon said target area corresponding to the latent image of the aperture pattern of said tensed foil;

(f) repeating steps (a) through (e) for each pattern of elemental phosphor deposits desired to be established;

(g) re-registering said frame means with said faceplate by mating said registration-affording means and said indexing means; and, (h) sealing said faceplate sealing area to said frame means sealing area with said registration-affording means and said indexing means in mating registration, whereby said frame means becomes an integral constituent of said cathode ray tube.

2. A method of making a color cathode ray tube utilizing a tensed color selection electrode assembly as a stencil for screening a pattern of luminescent phosphor deposits upon a faceplate having a target area and a peripheral sealing area, and a plurality of registration-affording means at selected locations in said sealing area, said faceplate electrode assembly, said faceplate and said funnel being utilizable as constitutents of a color cathode ray tube, said electrode assembly comprising:

frame means defining a central opening dimensioned to enclose said target area and including a peripheral sealing area;

a planar tensed foil bonded to said frame means and having a predetermined pattern of apertures;

means for bonding said faceplate, said funnel and said frame means such that said frame means becomes an integral part of the vacuum envelope for the tube during final assembly of the tube;

indexing means mechanically associated with said frame means, and said funnel, and cooperable with said faceplate registration-affording means to facilitate multiple registered matings of said frame means and said faceplace during said screening of said target area;

said method comprising:

(a) applying a photosensitive coating to said target area of said faceplate;

(b) registering said frame means with said faceplate to enable said foil to serve as a screen stencil by mating said registration-affording means and said indexing means to enable said foil to seek and effect a precise, repeatable registration with said targets area;

(c) causing said coating to be exposed to radiation actinic thereto through the pattern of apertures in said foil such that the latent image of the pattern formed in the photosensitive coating corresponds to the patterns of electron beam landings on the target area when the tube is finally assembled and operating;

(d) removing said frame means;

(e) processing said exposed coating to establish a pattern of elemental phosphor deposits upon said target area corresponding to the latent image of the aperture pattern of said tensed foil;

(f) repeating steps (a) through (e) for each pattern of elemental phosphor deposites desired to be established;

(g) registering said frame means with said faceplate and said funnel by mating said registration-affording means and said indexing means; and, (h) sealing said faceplate sealing area to said frame means sealing area, with said registration-affording means and said indexing means in mating registration in said faceplate sealing area, whereby said frame means becomes an integral constituent of said cathode ray tube 3. A method of making a color cathode ray tube having constitutents including a faceplate with a target area and a peripheral sealing area and registration affording means, a funnel with a peripheral sealing area with registration affording means at its mouth, and a tensed color selection electrode assembly utilizable as a stencil for screening a pattern of phosphor deposits on said target area of said faceplate, said electrode assembly comprising:

frame means defining a central opening dimensioned to enclose said target area and including peripheral sealing areas for mating with the sealing areas of said faceplate and said funnel;

a planar tensed foil bonded to said frame means and having a predetermined pattern of apertures;

means for bonding said frame means to said faceplate and said funnel such that said frame means becomes an integral part of the vacuum envelop for the tube during final assembly of the tube; and indexing means mechanically associated with said funnel registration affording means and said frame means, said frame indexing means being cooperable with said faceplate registration-affording means to facilitate multiple registered matings of said frame means and said faceplate during said screening of said target area;

said method comprising:

(a) applying a photosensitive coating to said target area of said faceplate;

(b) registering said frame means with said faceplate to enable said foil to serve as a screen stencil by mating said registration-affording means and said indexing means to enable said foil to seek and effect a precise, repeatable registration with said target area;

(c) causing said coating to be exposed to radiation actinic thereto through the pattern of apertures in said foil such that the latent image of the pattern formed in the photosensitive coating corresponds to the patterns of electron beam landings on the target area when the tube is finally assembled and operating;

(d) separating said faceplate from said frame means;

(e) processing said exposed coating to establish a pattern of elemental phosphor deposits upon said target area corresponding to the latent image of the aperture pattern of said tensed foil;

(f) repeating steps (a) through (e) for each pattern of elemental phosphor deposits desired to be established;

(g) registering said frame means with said faceplate and said funnel by mating said registration-affording means and said indexing means; and, (h) sealing said faceplate sealing area to said frame means sealing area, with said registration-affording means and said indexing means in mating registration with said faceplate sealing area and said funnel sealing area, whereby said frame means becomes an integral constituent of said cathode ray tube and (i) covering the external junction of the foil and said frame means with an insulating material effective to prevent external contact with the foil and a high electrical potential thereon.

* * * * *